United States Patent [19]

Kohama et al.

[11] 4,146,986

[45] Apr. 3, 1979

[54] DEVICE FOR SUPPLYING SECONDARY AIR FOR PURIFYING EXHAUST GASES DISCHARGED FROM INTERNAL COMBUSTION ENGINE

[75] Inventors: Tokio Kohama, Nishio; Hideki Obayashi, Aichi; Tadashi Ozaki, Nishio; Hidetaka Nohira, Susono, all of Japan

[73] Assignees: Nippon Soken, Inc., Nishio; Toyota Jidosha Kogyo Kabushiki Kaisha, Toyota, both of Japan

[21] Appl. No.: 744,824

[22] Filed: Nov. 24, 1976

[30] Foreign Application Priority Data

| | | | |
|---|---|---|---|
| Dec. 25, 1975 | [JP] | Japan | 50-157239 |
| Mar. 26, 1976 | [JP] | Japan | 51-34021 |
| May 26, 1976 | [JP] | Japan | 51-60935 |

[51] Int. Cl.[2] ..... F01N 3/10

[52] U.S. Cl. ..... 60/290; 60/278

[58] Field of Search ..... 60/289, 290, 278; 423/119 A

[56] References Cited

U.S. PATENT DOCUMENTS

| | | | |
|---|---|---|---|
| 3,696,615 | 10/1972 | Boyd | 60/289 |
| 3,826,089 | 7/1974 | Nakajima | 60/289 |
| 3,906,723 | 9/1975 | Matumoto | 60/290 |
| 3,927,524 | 12/1975 | Cholvin | 60/289 |
| 3,945,205 | 3/1976 | Atago | 60/290 |
| 3,974,651 | 8/1976 | Nakajima | 60/290 |
| 4,047,510 | 9/1977 | Nakajima | 123/119 A |

*Primary Examiner*—Douglas Hart

*Attorney, Agent, or Firm*—Cushman, Darby & Cushman

[57] ABSTRACT

A device for supplying secondary air in proportion to the volume of intake air into the exhaust manifold of an internal combustion engine without any adverse effects on an exhaust gas recirculation system, the device comprising a secondary air supply pipe communicated with the exhaust manifold, means for supplying secondary air through the secondary air supply pipe into the exhaust manifold, secondary air control valve means disposed in the secondary air supply pipe for controlling the flow rate of secondary air flowing therethrough, means for detecting the volume of intake air to said engine, means for detecting the volume of the secondary air flowing through the secondary air supply pipe, and means responsive to both the signal representative of the detected volume of intake air and the signal representative of the detected volume of the secondary air supply for controlling the secondary air control valve means in such a way that the secondary air supply may be in proportion to the volume of intake air.

6 Claims, 12 Drawing Figures

DEVICE FOR SUPPLYING SECONDARY AIR FOR PURIFYING EXHAUST GASES DISCHARGED FROM INTERNAL COMBUSTION ENGINE

BACKGROUND OF THE INVENTION

The present invention relates to a device for supplying secondary air for purifying exhaust gases discharged from an internal combustion engine.

The exhaust gases discharged from an internal combustion engine contain toxic compounds; that is, CO, HC and NOx. CO and HC are unburned compounds so that secondary air may be charged into the exhaust gases to burn them. For this purpose, air pumps which are driven by the engines are generally used, but in some engines the secondary air is charged by utilizing the pulsation of exhaust gas pressure in the exhaust system. To remove NOx, the exhaust gas recirculation systems have been widely used and may be generally divided into the following two types depending upon the underlying principles:

(1) the type in which fixed restriction means is used for controlling the volume of exhaust gases to be recirculated from the exhaust pipe to the intake pipe of the engine as a function of the back pressure (the exhaust gases to be recirculated being charged into the intake pipe upstream of the throttle valve), and (2) the type in which a variable restriction means is used for controlling the volume of exhaust gases to be recirculated (the exhaust gases to be recirculated being charged into the intake pipe downstream of the throttle valve). The basic principle common in both types is that the volume of exhaust gases to be recirculated is made proportional to the volume of intake air.

The quantities of unburned compounds in the exhaust gases are generally in proportion to the volume of intake air so that it follows that the secondary air to be charged into the exhaust system for burning the unburned compounds must be made proportional to the volume of intake air. Therefore when the engine load is high so that the volume of intake air is greater, the secondary air supply must be increased accordingly. On the other hand when the engine load is low so that the volume of intake air is small, the secondary air supply must be decreased accordingly. Therefore the secondary air supply must be controlled depending upon the load even when the engine is running at the constant speed. However, the conventional air pump for supplying the secondary air is driven by the engine so that the discharge is dependent only on the rotational speed of the engine, but is completely independent of the load. In the conventional secondary air supply system of the type utilizing the pulsation of exhaust gases, the secondary air supply is dependent upon the negative pressure produced by the pulsation of the exhaust gas pressure and the number or periodic cycle of negative pressure created. Since these two factors are entirely dependent upon the rotational speed of the engine, the secondary air supply is also dependent upon the rotational speed.

Therefore in the conventional secondary air supply systems, the secondary air supply is adjusted in quantity sufficient to burn the unburned compounds discharged when the engine is running with high load so that the insufficient supply of secondary air may be avoided. As a result of this, the secondary air is supplied in excessive quantities when the engine is running at the same speed but with light load so that the exhaust gas purifying device such as a thermal reactor is overcooled by the excessive secondary air with the resultant poor performance of the purifying device.

When the conventional secondary air supply systems are used together with the exhaust gas recirculation systems, the former adversely affects the latter. In case of the exhaust gas recirculation system of the type (1) above, the volume of the exhaust gases to be recirculated is controlled as a function of the back pressure, which is a function of the volume of intake air. However, when the secondary air is supplied independently of the volume of intake air, the above relationship between the back pressure and the volume of intake air cannot be held any longer. Therefore the volume of the exhaust gases to be recirculated is deviated from the optimum level which must be dependent upon the volume of intake air. Similar phenomenon is observed when the performance of the air pump drops. As a result, the exhaust gases tend to be recirculated in excessive quantities especially when the engine is running under light load so that the engine operation is adversely affected. The same problem is also observed in the exhaust gas recirculation system of the type (2) when combined with the conventional secondary air supply systems.

SUMMARY OF THE INVENTION

In view of the above, one of the objects of the present invention is to provide a secondary air supply device for use with an internal combustion engine which can supply an optimum quantity of secondary air in proportion to the volume of intake air so as to depend upon the variation of load, whereby the substantial reduction of unburned compounds in the exhaust gases may be ensured.

Another object of the present invention is to ensure the optimum recirculation of exhaust gases in an exhaust gas purifying system including a secondary air supply system and an exhaust gas recirculation system by the supply of secondary air in proportion to the volume of intake air.

To the above and other ends, the present invention provides a device for supplying secondary air for purifying exhaust gases discharged from an internal combustion engine comprising a secondary air supply pipe communicated with the exhaust manifold or pipe of the engine, means for supplying secondary air through said secondary air supply pipe into the exhaust manifold or pipe, secondary air control valve means for controlling the flow rate of the secondary air flowing through said secondary air supply pipe, means for detecting the volume of intake air, means for detecting the volume of secondary air flowing through said secondary air supply pipe, and means responsive to the signal representative of the detected volume of intake air and the signal representative of the detected volume of secondary air for controlling said secondary air control valve means in such a way that the secondary air supply is in proportion to the volume of intake air.

Said means for supplying secondary air into the exhaust manifold or pipe is of the type utilizing an air pump or the type in which the pulsation of exhaust gases in the exhaust system is utilized for charging the secondary air into the exhaust manifold or pipe. Said secondary air control valve means is in general a butterfly valve, but when an air pump is employed as means for supplying secondary air, a poppet valve may be used which controls the degree of opening of an air vent or port communicated with the secondary air supply pipe.

The advantages of the use of the poppet valve are the reduction of load on the air pump and the considerably long service life thereof.

According to one embodiment of the present invention, the transmission of at least either of the signal representative of the detected volume of intake air or the signal representative of the detected volume of secondary air supply to the control means may be delayed so that the volume of secondary air supply may be greater or less than a volume in proportion to the volume of intake air in case of the acceleration or deceleration of the engine, whereby the change in air-fuel ratio caused by the sudden change of the engine operating conditions may be compensated.

According to a preferred embodiment of the present invention, the negative pressure at the throat of the venturi of the carburetor of the engine is used as the signal representative of intake air, and used as the signal representative of secondary air supply is the pressure difference across a restriction means inserted into the secondary air supply pipe or the negative pressure at the throat of the restriction means. The secondary air control valve is so arranged as to respond in one direction in proportion to the negative pressure at the throat of the venturi of the carburetor and in the other direction in proportion to the pressure difference across the restriction or the negative pressure at the throat thereof. The pressure of the secondary air flowing through the secondary air supply pipe; that is, the secondary air injection pressure may be used as the signal representative of the secondary air supply.

The above and other objects, features and advantages of the present invention will become more apparent from the following decription of the preferred embodiments thereof taken in conjunction with the accompanying drawings.

DESCRIPTION OF THE PREFERRED EMBODIMENTS

Figure 1:
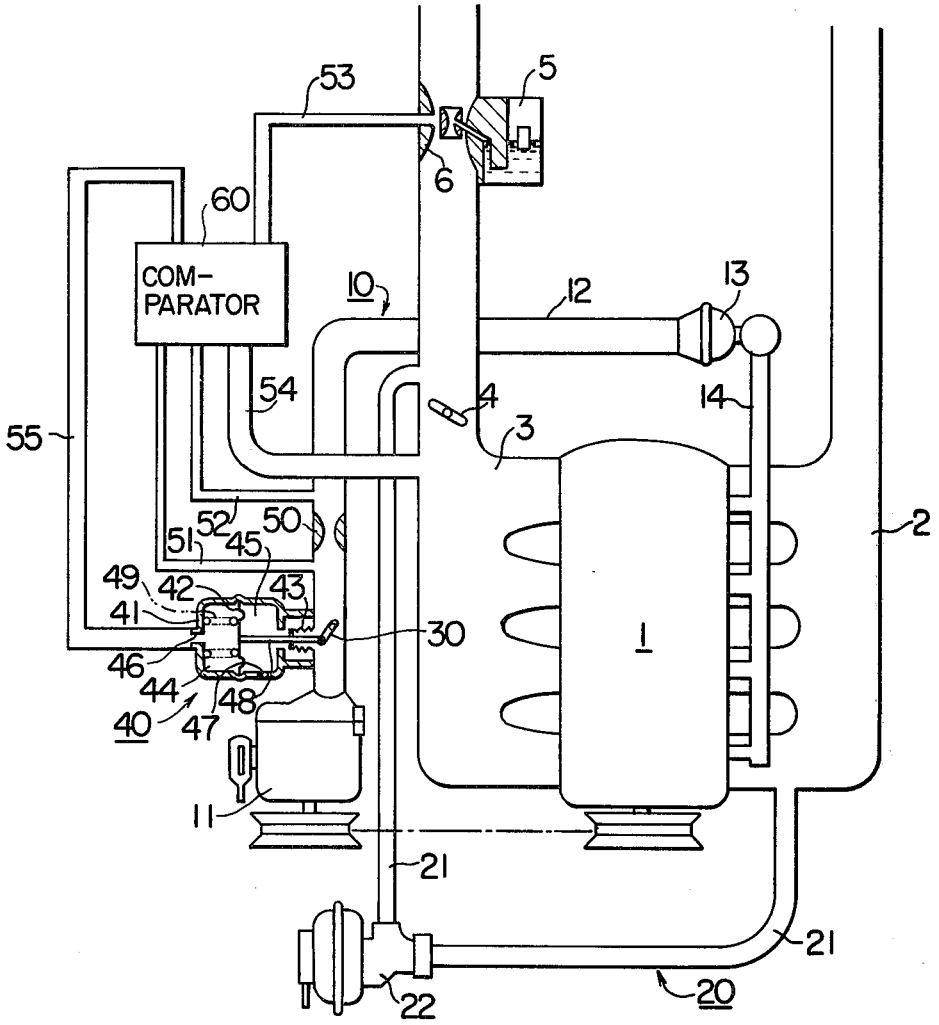
FIG. 1 is a schematic view of a first embodiment of a secondary air supply device in accordance with the present invention incorporated in an internal combustion engine.
Figure 2:
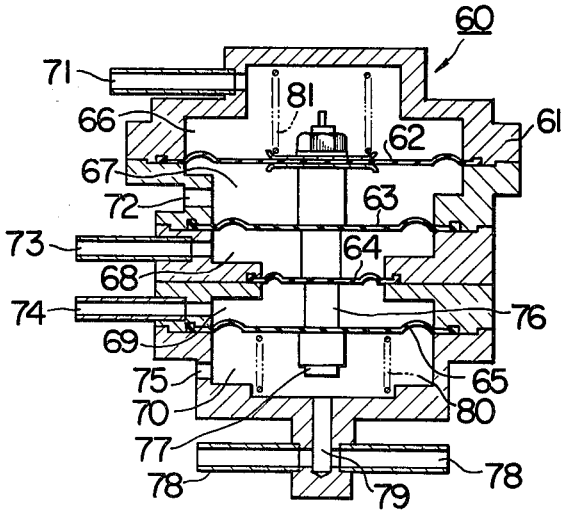
FIG. 2 is a sectional view of a comparator used in the first embodiment.
Figure 3:
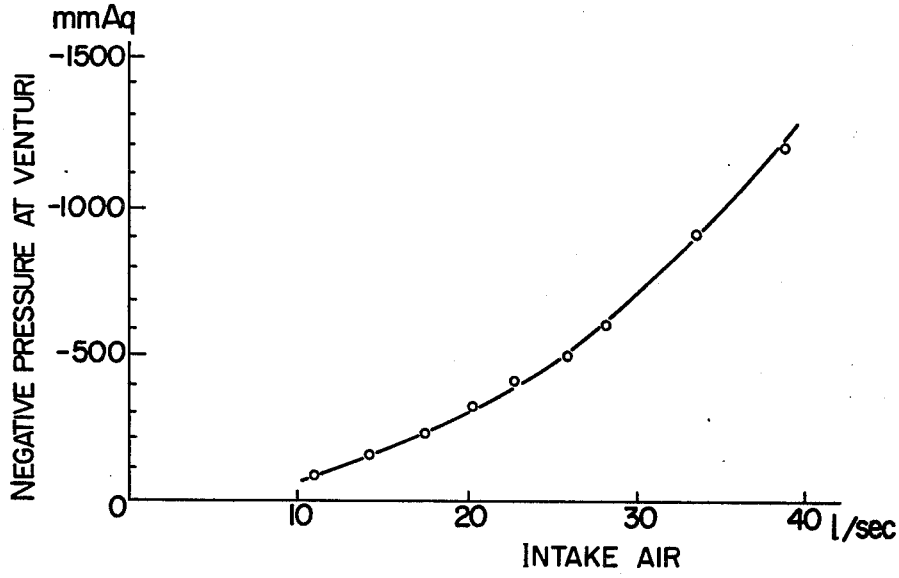
FIG. 3 is a graph used for the explanation of the mode of operation of the present invention.

First Embodiment, FIGS. 1, 2 and 3

In FIG. 1 there is shown a first embodiment of the present invention including an internal combustion engine 1 with an exhaust manifold 2 and an intake manifold 3 including a throttle valve 4 and a carburetor 5 disposed upstream of the throttle valve 4. The carburetor 5 includes a venturi 6 inserted in the intake manifold 3.

A secondary air supply device generally indicated by the reference numeral 10 comprises an air pump 11, a secondary air supply pipe 12, a check valve 13 and a secondary air injection nozzle 14. The air pump 11 is drivingly coupled to the engine 1 with a belt. One end of the secondary air supply pipe 12 is connected to the discharge port (not shown) of the air pump 11 while the other end, to the check valve 13 which in turn is connected to the injection nozzle 14. The injection nozzle 14 is opened into the respective branches of the raked exhaust manifold 2. The secondary air supply pipe 12 and the injection nozzle 14 constitute a passage for supplying the air from the air pump 11 into the exhaust manifold 2.

An exhaust gas recirculation system generally indicated by 20 includes an exhaust gas recirculation pipe 21 and a control valve 22. One end of the recirculation pipe 21 is connected to the exhaust manifold 2 while the other end is opened into the intake pipe 3 upstream of the throttle valve 4. The control valve 22, which is inserted in the recirculation pipe 21, has a function of recirculating portion of the exhaust gases through the recirculation pipe 21 and controlling the volume of the recirculated exhaust gases as a function of the pressure (back pressure) of the exhaust gases in the exhaust manifold 2.

In addition to the above conventional device and system, the present invention further provides a secondary air control valve 30 in the secondary air supply pipe 12. The control valve 30 is actuated by an actuating device 40 for varying the sectional area of the secondary air supply pipe 12. In the instant embodiment the secondary air control valve 30 consists of a butterfly type throttle valve which is rotatably disposed within the secondary air supply pipe 12 for throttling the flow of the secondary air. The control valve 30 is disposed upstream of the check valve 13.

The present invention further provides a comparator 60 which derives the control signal in response to the signal representative of the volume of intake air and the signal representative of the volume of secondary air, and the actuating device 40 is actuated in response to the control signal from the comparator 60.

In the first embodiment, used as the signal representative of the volume of secondary air is the pressure difference across a restriction 50 inserted in the secondary air supply pipe 12 downstream of the secondary air control valve 30. More particularly, the pressures at the inlet and outlet of the restriction 50 are tapped and transmitted through first and second pressure tapping pipes 51 and 52, respectively, to the comparator 60. Used as the signal representative of the volume of intake air is the negative pressure produced at the venturi 6 which is tapped and transmitted through a third pressure tapping pipe 53 to the comparator 60. Used as the control signal is the negative intake air pressure downstream of the throttle valve 4 which is tapped and transmitted through a fourth pressure tapping pipe 54 to the comparator 60. In the comparator 60, the control signal or negative intake air pressure is regulated and transmitted through a fifth pressure pipe 55 to the actuating device 40.

The actuating device 40 includes a housing 41 defining therein a compartment which is divided into pressure chambers 44 and 45 by a diaphragm 42 and a sealing bellows 43 at one open end of the housing 41. The control signal or the negative intake air pressure is admitted into the first pressure chamber defined by the housing 41 and the diaphragm 42 through the fourth pressure tapping pipe 54, the comparator 60 and the fifth pressure pipe 55 and a port 46 of the housing 41, and the atmospheric pressure is admitted through a port 47 into the second pressure chamber 45 defined by the housing 41, the diaphragm 42 and the sealing bellows 42. One end of a shaft 48 is connected to the diaphragm 42 while the other end, to the secondary air control valve 30. A range or bias spring 49 is loaded in the first pressure chamber 44 so as to normally biase the diaphragm 42 to the right in FIG. 1.

Therefore the degree of opening of the secondary air control valve 30 is dependent upon the balance between the force of the spring 49 tending the diaphragm 42 to the right and the control signal or negative intake air pressure acting on the diaphragm 42 to force it to the left. When the control signal is greater than the force of the spring 49, the diaphragm 42 is displaced to the left so that the secondary air control valve 30 is rotated in the clockwise direction thereby reducing the sectional area of the secondary air supply pipe 12 and hence the flow rate of secondary air. On the other hand, when the control signal is smaller, the diaphragm 49 is displaced to the right so that the secondary air control valve 30 is rotated in the counterclockwise direction and consequently the sectional area of the secondary air supply pipe 12 is increased to increase the flow rate of secondary air.

Next referring particularly to FIG. 2, the construction as well as mode of operation of the comparator 60 used in the first embodiment will be described in detail. The comparator 60 has a housing 61 which is divided into first, second, third, fourth and fifth pressure chambers 66, 67, 68, 69 and 70 by first, second, third and fourth diaphragms 62, 63, 64 and 65. The first pressure chamber 66 defined by the housing 61 and the first diaphragm 62 is communicated with the throat of the venturi 6 through a first pipe 71 and the third pressure tapping pipe 53 (see FIG. 1). Atmospheric pressure is admitted through a port 72 into the second pressure chamber 67 defined between the first and second diaphragms 62 and 63. The pressure at the outlet of the restriction 50 of the secondary air supply pipe 12 is admitted through the second pressure tapping pipe 52 and a second pipe 73 into the third pressure chamber 68 between the second and third diaphragms 63 and 64. The pressure at the inlet of the restriction 50 is admitted through the first pressure tapping pipe 51 and a third pipe 74 into the fourth pressure chamber 69 defined between the third and fourth diaphragms 64 and 65. It should be noted that the pressure admitted into the fourth pressure chamber 69 is higher than the pressure admitted into the third pressure chamber 68 because of the insertion of the restriction 50 in the secondary air supply pipe 12 and that these pressures are positive. Atmospheric pressure is admitted through a second air port 75 into the fifth pressure chamber 70 defined by the housing 61 and the fourth diaphragm 65. These four diaphragms 62, 63, 64 and 65 are connected with a shaft 76, and a valve body 77 is attached to the lower end of the shaft 76 for opening or closing a port 79 intercommunicating the fifth pressure chamber 70 and a fourth pipe 78. One end of the fourth pipe 78 is connected to the fourth pressure tapping pipe 54 (See FIG. 1) for tapping the pressure downstream of the throttle valve 4 while the other end, to the fifth pressure pipe 55 (See FIG. 1) so that the negative intake air pressure may be admitted into the fifth pressure pipe 55 and hence to the actuating device 40. First and second range springs 80 and 81 are loaded in the fifth and first pressure chambers 70 and 66, respectively, to settle the original position of the valve body 77. It should be noted that the third diaphragm 64 has a pressure receiving area smaller than those of other diaphragms 62, 63 and 65.

Since the negative pressure at the throat of the venturi 6 is admitted into the first pressure chamber 66, the first diaphragm 62 tends to be displaced upwardly, and since the positive pressure is admitted into the third pressure chamber 68, the second diaphragm 63 also tends to be displaced upwardly. On the other hand the fourth diaphragm 65 tends to be displaced downwardly because the positive pressure is admitted into the fourth pressure chamber 69. The third diaphragm 64 is slightly forced upwardly due to the difference in pressure in the third and fourth pressure chambers 68 and 69. The combined force W; that is the forces acting on the second, third and fourth diaphragms 63, 64 and 65 is directed downwardly because of the difference in pressure between the third and fourth pressure chambers. Therefore the position of the shaft 76 and hence the valve body 77 is dependent upon the balance of the venturi throat pressure admitted into the first pressure chamber to cause the first diaphragm 62 and hence the shaft 76 to move upwardly with the combined force W which tends to displace the shaft 76 downwardly. Under the balanced condition as shown in FIG. 2, when the negative throat pressure admitted into the first pressure chamber 66 increases with the increase in volume of intake air, the shaft 76 and hence the valve body 77 are displaced upwardly so that the flow rate of atmospheric air flowing through the port 79 into the fourth pipe 78 increases and consequently the negative intake air pressure in the fourth pipe 78 decreases. On the other hand, when the negative venturi throat pressure admitted into the first pressure chamber 66 is decreased, the valve body 77 is displaced downwardly, thereby reducing or completely interrupting the atmospheric air flowing into the fourth pipe 77 so that the negative intake air pressure transmitted through the fourth pipe 78 is increased. With the increase in volume of secondary air, when the difference in pressure between the third and fourth pressure chambers 68 and 69; that is, the pressure difference across the restriction 50 in the secondary air supply pipe 12 is increased, the shaft 76 and hence the valve body 77 are displaced downwardly so that the atmospheric air flowing into the fourth pipe 78 is reduced or completely interrupted and consequently the negative intake pressure transmitted through the fourth pipe 78 is increased. On the other hand when the pressure difference across the restriction 50; that is, the pressure difference between the third and fourth pressure chambers 68 and 69 decreases, the valve body 77 is displaced upwardly so that the flow rate of the atmospheric air flowing into the fourth pipe 78 is increased and consequently the negative intake air pressure transmitted therethrough is decreased accordingly.

Air whose volume is dependent upon the degree of opening of the throttle valve 4, is mixed with fuel in the carburetor 5 and the air-fuel mixture is charged into the engine 1, burned and discharged through the exhaust manifold or pipe 2 into the surrounding atmosphere.

The negative pressure at the throat of the venturi 6 is corelated with the volume of intake air as shown in FIG. 3 and in the following equation:

$$Q=C_1 \cdot A_1 \cdot \sqrt{\Delta P}$$

where

Q=volume of intake air, $A_1$=sectional area of venturi 6, $\Delta P$=absolute value of negative pressure at the throat of venturi 6, and $C_1$=flow coefficient.

In the meantime, the air pump 11 of the secondary air supply system which is driven by the engine 1 pressurizes secondary air and forces it to flow through the secondary air supply pipe 12 and the check valve 13 into the nozzle 14 from which the compressed secondary air is injected into the branches of the exhaust manifold 2 so that the unburned components CO and HC in the exhaust gases are burned and consequently the content of unburned compounds in the exhaust gases may be reduced.

The difference in pressure between the inlet and outlet of the restriction 50 in the secondary air supply pipe 50 is corelated with the volume of secondary air in the following equation:

$$q=C_2 \cdot A_2 \sqrt{\Delta P'}$$

where q=volume of secondary air, $A_2$=cross sectional area of restriction 50, $\Delta P'$=pressure difference across restriction 50, and $C_2$=flow coefficient.

As described previously, the secondary air control valve 30 is actuated by the actuating device 40 which in turn is actuated by the negative intake air pressure which in turn is regulated by the comparator 60 which compares the venturi throat pressure with the pressure difference across the restriction 50. The secondary air control valve 30 therefore controls the sectional area of the secondary air supply pipe 12 in such a way that the pressure difference across the restriction 50 may be in proportion to the absolute value of the pressure at the throat of the venturi 6. Therefore the following relation is established:

$$\Delta P=K_1 \cdot \Delta P'$$

where $K_1$ is a proportionality constant. Then $$Q=q \cdot K_2$$

where $K_2$ is a proportionality constant. Hence, the volume of secondary air to be injected is in proportion to the volume of intake air.

Next the mode of operation of the first embodiment with the above construction will be described in more detail hereinafter. It is assumed that under the conditions shown in FIG. 1 the signal representative of the volume of intake air is in proportion to the signal representative of the volume of secondary air. When the volume of intake air increases with the resultant increase in the negative pressure at the throat of the venturi 6, the comparator 60 so functions that the negative pressure admitted into the first pressure chamber 44 of the actuating device 40 decreases and consequently the secondary air control valve 30 is opened to increase the cross sectional area of the secondary air supply pipe 12. As a result, the flow rate of secondary air flowing through the secondary air pipe 12, the check valve 13 and the injection nozzle 14 increases. On the other hand when the volume of intake air decreases with the resultant decrease in negative pressure at the throat of the venturi 6, the comparator 60 so functions that the negative pressure admitted into the first pressure chamber 44 of the actuating device 40 increases and consequently the secondary air control valve 30 is rotated in the direction in which the cross sectional area of the secondary air supply pipe 12 decreases, whereby the volume of secondary air injected into the exhaust manifold 2 is reduced.

When the volume of secondary air is inreased so that the pressure difference across the restriction 50 is increased, the comparator 60 so functions that the negative pressure admitted into the first pressure chamber 44 of the actuating device 40 is increased and the secondary air control valve 30 is rotated in the direction in which the cross sectional area of the secondary air pipe 12 is decreased, whereby the volume of secondary air to be injected into the exhaust manifold 2 may be decreased. On the other hand when the volume of secondary air is decreased so that the pressure difference across the restriction 50 is decreased accordingly, the negative pressure admitted into the first pressure chamber 44 of the actuating device 40 is decreased and consequently the secondary air control valve 30 is opened, whereby the volume of secondary air to be injected into the exhaust manifold 2 may be increased.

Therefore the volume of secondary air to be injected into the exhaust manifold may be made proportional to the volume of intake air by controlling the secondary air control valve 30 in such a way that the signal representative of the volume of secondary air may be in proportion to the signal representative of the volume of intake air. When the volume of secondary air is made proportional to the volume of intake air in the manner described above, secondary air sufficient in volume for burning or purifying the unburned components in the exhaust gases may be always injected into the exhaust manifold. In other words, excess supply of secondary air may be prevented, and insufficient supply of secondary air will not occur. Thus the problem of over-cooling the exhaust gas purifying device may be overcome, and the positive purification or reduction of unburned compounds in the exhaust gases may be ensured.

The exhaust gas recirculation system 20 controls the volume of exhaust gases to be recirculated as a function of the back pressure, and will not be adversely affected by the secondary air supply system because the supply of secondary air in proportion to intake air may maintain the condition under which the exhaust gases to be recirculated be in proportion to the volume of intake air.

Figure 4:
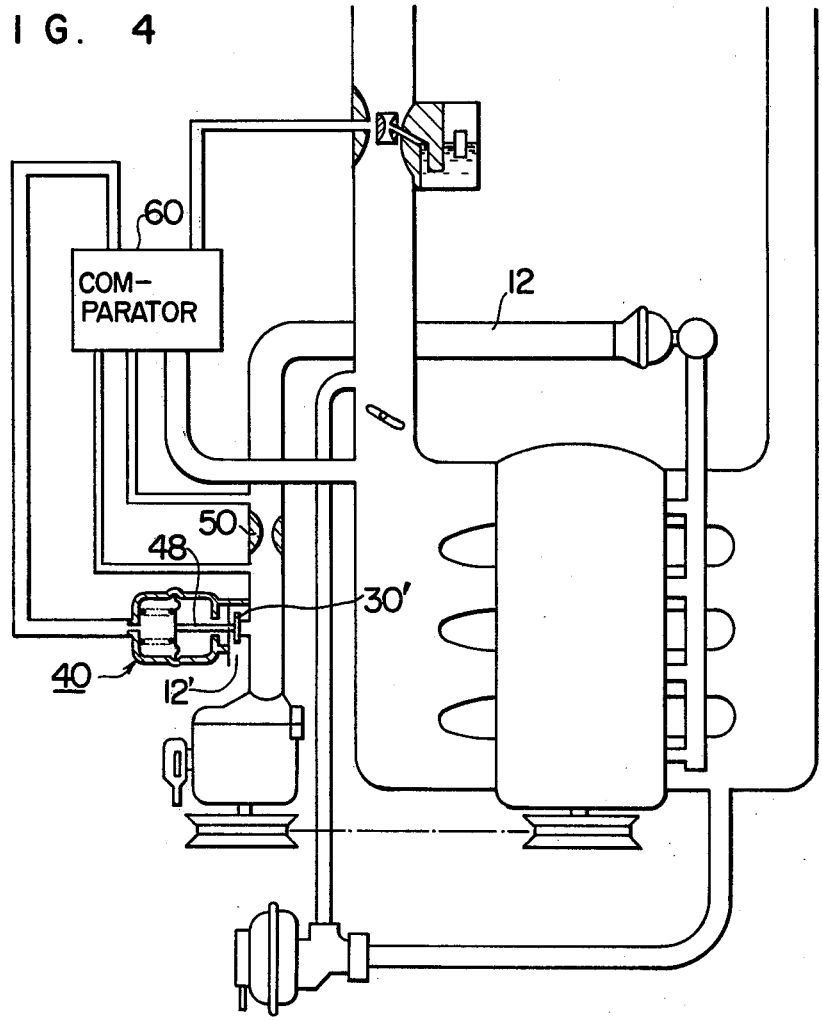
FIG. 4 is a schematic view of a second embodiment of the present invention.

Second Embodiment, FIG. 4

The second embodiment to be described below with reference to FIG. 4 is substantially similar in construction and mode of operation to the first embodiment described above except that instead of the butterfly type secondary air control valve 30, a conventional poppet valve 30' is used. As shown in FIG. 4, in the second embodiment the secondary air supply pipe 12 is formed with an air vent 12', and the poppet valve 30' is so arranged as to control the ratio of the cross sectional area of the secondary air supply pipe 12 to the opening area of the air vent 12'. For this purpose, the poppet valve 30' is connected to the shaft 48 of the actuating device 40.

When the signal representative of the pressure difference across the restriction 50 increases in excess as compared with the signal representative of the volume of intake air, the comparator 60 so functions that the shaft 48 of the actuating device 40 is shifted to the left in FIG. 4 so that the opening area of the air vent 12' is increased and consequently the secondary air to be injected into the exhaust manifold 2 may be reduced in volume. On the other hand, when the signal representative of the pressure difference across the restriction 50 is small as compared with the signal representative of the volume of intake air, the shaft 48 is displaced to the right in FIG. 4 so that the opening air vent 12' is decreased and consequently the secondary air to be injected into the exhaust manifold 2 may be increased in volume. Thus the second embodiment of the present invention may accomplish the same features and effects as the first embodiment. One of the advantages of the second embodiment lies in that portion of the compressed secondary air delivered from the air pump 11 is discharged through the air vent 12' into the surrounding atmosphere so that the load on the air pump 11 may be decreased and consequently the service life thereof may be considerably increased.

Figure 5:
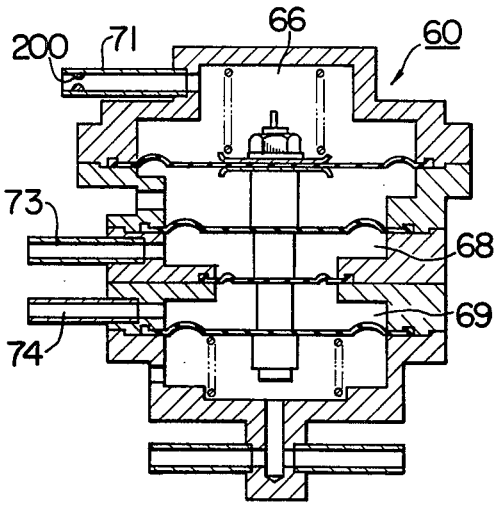
FIG. 5 is a sectional view of a comparator used in a third embodiment of the present invention.

Third Embodiment, FIG. 5

The third embodiment to be described below with particular reference to FIG. 5 is substantially similar in construction to the first embodiment described above except that a restriction 200 is inserted into the first pipe 71 of the comparator 60. Therefore some delay may be introduced into the response to the negative venturi throat pressure to be admitted into the first pressure chamber 66 of the comparator 60 so that when the engine 1 is accelerated the volume of secondary air may be less than the volume in proportion to the volume of intake air while in case of the deceleration the volume of secondary air may be increased beyond the volume in proportion to the volume of intake air. This mode of operation will be described in more detail below.

When the throttle valve 4 is opened, the negative pressure at the throat of the venturi 6 in the carburetor 5 is increased, but the transmission of this increased throat pressure to the first pressure chamber 66 is delayed by the restriction 200 inserted in the first pipe 71 so that the volume of secondary air to be injected into the exhaust manifold 2 remains unchanged for some time without immediately responding to the increase of the venturi throat pressure. Therefore the volume of secondary air is less than a volume in proportion to the volume of intake air. On the other hand when the throttle valve 4 is closed, the venturi throat pressure is decreased, but the transmission of the decreased throat pressure to the first pressure chamber 66 of the comparator 60 is also delayed by the restriction 200 so that the volume of secondary air is for some time more than a volume in proportion to the volume of intake air. In case of deceleration of the engine 1, the negative pressure of the intake air increases so that the fuel deposited or otherwise on the wall of the intake pipe 3 is entrained in intake air and charged into the engine and consequently the air-fuel ratio temporarily decreases. However, the above mode of operation ensures effective purification or reduction of toxic compounds in the exhaust gases.

The same effect can be attained by the insertion of a restriction or delay means in the second pipe 73. In case of deceleration of the engine 1 the negative pressure at the throat of the venturi is decreased so that the secondary air is decreased in volume and the pressures admitted into the third and fourth pressure chambers 68 and 69 are decreased accordingly. However the restriction in the second pipe 73 serves to maintain the pressure in the third pressure chamber 68 at the previous level for a while so that the pressure difference between the third and fourth pressure chambers 68 and 69 is decreased below a pressure difference across the restriction 50 in the secondary air supply pipe 12. In other words, the signal representative of the volume of secondary air less than the real volume is applied to the comparator 60 so that the latter so functions as to increase the volume of secondary air in excess of a volume in proportion to the volume of intake air for a while.

In like manner, a restriction may be inserted into the third pipe 74 so that in case of acceleration the volume of secondary air may be increased in excess of a volume in proportion to intake air while in case of deceleration the volume of secondary air may be reduced less than a volume in proportion to the volume of intake air. When the engine 1 is accelerated, the pressure at the throat of the venturi is increased so that the comparator 60 so function as to increase the volume of secondary air. As a result of this, the pressures admitted to the third and fourth pressure chambers 68 and 69 should be increased, but in practice the restriction inserted in the third pipe 74 serves to maintain temporarily the pressure in the fourth pressure chamber 69 at the previous level. As a consequence, the pressure difference between the third and fourth pressure chambers 68 and 69 is less than a pressure difference across the restriction 50 in the secondary air supply pipe 12 for a while. Therefore the comparator 60 derives the signal representative of the volume of secondary air less than the real volume being supplied to the exhaust manifold so that the volume of secondary air is increased temporarily in excess of a volume in proportion to the intake air. On the other hand in case of deceleration the throat pressure is decreased so that the volume of the secondary air is also decreased. The pressure in the fourth pressure chamber 69 is maintained for some time at the previous level because of the insertion of the restriction in the third pipe 74 so that the pressure difference between the third and fourth pressure chambers 68 and 69 is greater than the pressure difference across the restriction 50 in the secondary air supply pipe 12. In the compartor 60, therefore, the signal representative of the volume of secondary air less than the real volume being supplied is derived so that the volume of secondary air is decreased temporarily below a volume in proportion to the volume of intake air. Therefore even though the air-fuel ratio is decreased in case of the acceleration because an acceleration pump is actuated, the above mode of operation ensures the effective purification or reduction of toxic compounds in the exhaust gases.

A further unique feature may be obtained by the insertion of restrictions in both the second and third pipes 73 and 74. In case of the acceleration of the engine 1, the negative pressure at the throat of the venturi is increased so that the volume of secondary air is also increased. However, the restrictions in the third and fourth pipes 73 and 74 serve to maintain for a while the pressures in the third and fourth pressure chambers 68 and 69 at the previous levels so that the pressure difference between the pressure chambers 68 and 69 is less than a pressure difference across the restriction 50 in the secondary air supply pipe. Therefore in the comparator 60, the signal representative of the volume of secondary air less than the real volume being supplied is derived so that the secondary air is increased in volume in excess of a volume in proportion to the volume of intake air for a while.

As described above, according to the third embodiment delay means or restrictions are arranged so as to delay the admittance of the signal representative of the volume of intake air to the first pressure chamber of the comparator and of both or either of the signals representative of the volume of secondary air into the third and/or fourth pressure chambers. Therefore, in addition to the effects, features and advantages of the first embodiment described above, the third embodiment has the very desired feature that the toxic compounds discharged in large quantity especially in case of acceleration or deceleration of the engine may be purified or reduced in a very efficient manner.

Figure 6:
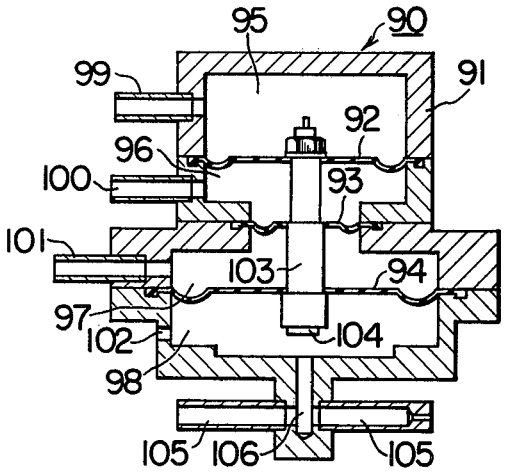
FIG. 6 is a sectional view of a comparator used in a fourth embodiment of the present invention.

Fourth Embodiment, FIG. 6

The fourth embodiment to be described below is substantially similar in construction to the first embodiment except that instead of the comparator 60 a comparator 90 as shown in FIG. 6 is used. The comparator 90 has a housing 91 which is divided by first, second and third diaphragms 92, 93 and 94 into first, second, third and fourth pressure chambers 95, 96, 97 and 98. Admitted into the first pressure chamber 95 defined by the housing 91 and the first diaphragm 92 is the negative pressure at the throat of the venturi 6 through the third pressure tapping pipe 53 (See FIG. 1) and a first pipe 99. Admitted into the second pressure chamber 96 defined between the first and second diaphragms 92 and 93 is the pressure at the outlet of the restriction 50 in the secondary air supply pipe 12 (See FIG. 1) through the second pressure tapping pipe 52 and a second pipe 100. Admitted into the third pressure chamber 97 defined between the second and third diaphragms 93 and 94 is the pressure at the inlet of the restriction 50 in the secondary air supply pipe 12 through the first pressure tapping pipe 51 and a third pipe 101. Atmospheric pressure is admitted through a port 102 into the fourth pressure chamber 98 defined by the housing 91 and the third diaphragm 94. These three diaphragms 92, 93 and 94 are connected with a shaft 103, and a valve body 104 is attached to the lower end of the shaft 103 for opening or closing a port 106 intercommunicating the fourth pressure chamber 98 and a fourth pipe 105. One end of the fourth pipe 105 is connected to the fourth pressure tapping pipe 54 so that the negative pressure downstream of the throttle valve 4 may be admitted while the other end, to the fifth pressure pipe 55 (See FIG. 1). It should be noted that the pressure receiving area of the second diaphragm 93 is smaller than those of other diaphragms 92 and 94.

The first diaphragm 92 tends to be displaced upwardly by the positive pressure admitted into the second pressure chamber 96 while the positive pressure admitted into the third pressure chamber 97 tends to displace the third diaphragm 94 downwardly. The second diaphragm 93 tends to be displaced slightly upwardly because of the pressure difference between the second and third pressure chambers 96 and 97. The combination of these forces or pressures tending to displace the first diaphragm 92 upwardly, to displace the second diaphragm 93 slightly upwardly and to displace the third diaphragm 94 downwardly results in the resultant $W_1$ tending to displace the shaft 103 downwardly, and the resultant $W_1$ is corelated with the volume of secondary air. Since the negative pressure at the throat of the venturi is admitted into the first pressure chamber 95, the first diaphragm 92 is displaced upwardly, and the displacement of the diaphragm 92 is corelated with the volume of intake air. Therefore the position of the shaft 103 and hence the valve body 104 is dependent upon the balance between the resultant $W_1$ and the negative venturi throat pressure admitted into the first pressure chamber 95. When the negative pressure admitted into the first pressure chamber 95 is increased with increase in volume of intake air, the shaft 103 and hence the valve body 104 are displaced upwardly so that the flow rate of the atmospheric air flowing through the port 106 into the fourth pipe 105 is increased and consequently the negative pressure transmitted through the fourth pipe 105 is decreased. On the other hand when the venturi throat pressure is decreased, the valve body 104 moves toward the port 106 so that the atmospheric air flowing through the port 106 into the fourth pipe 104 is reduced or completely interrupted and consequently the negative pressure transmitted through the fourth pipe 105 is increased. When the pressure difference between the second and third pressure chambers 96 and 97 is increased; that is, when the pressure difference across the restriction 50 in the secondary air supply pipe 12 (See FIG. 1) is increased, the valve body 104 moves toward the port 106 so that the negative pressure transmitted through the fourth pipe 105 is increased. On the other hand, when the pressure difference between the second and third pressure chambers 96 and 97; that is, across the restriction 50 is decreased, the valve body 104 moves away from the port 106 so that the negative pressure in the fourth pipe 105 is decreased.

Thus the comparator 90 may attain the same effects, features and advantages of the comparator 60 and therefore may be incorporated in the first, second and third embodiments.

Figure 7:
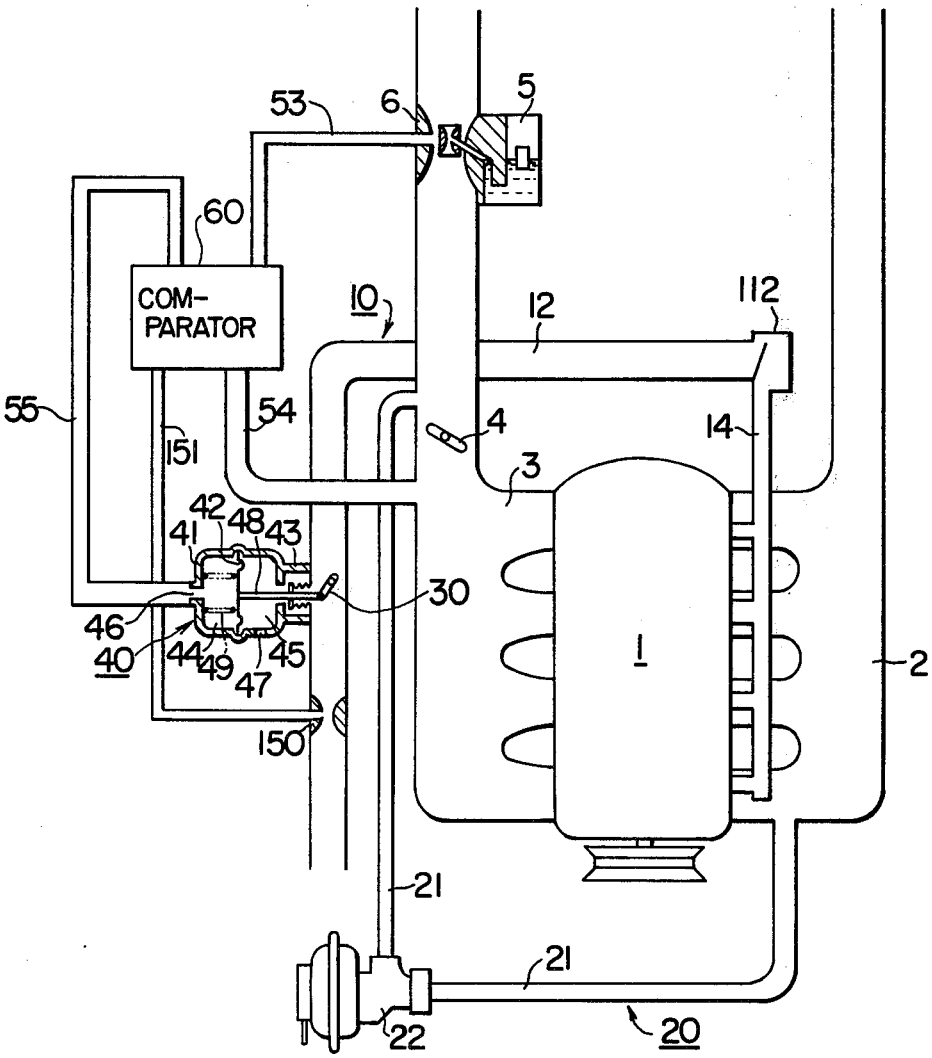
FIG. 7 is a schematic view of a fifth embodiment.
Figure 8:
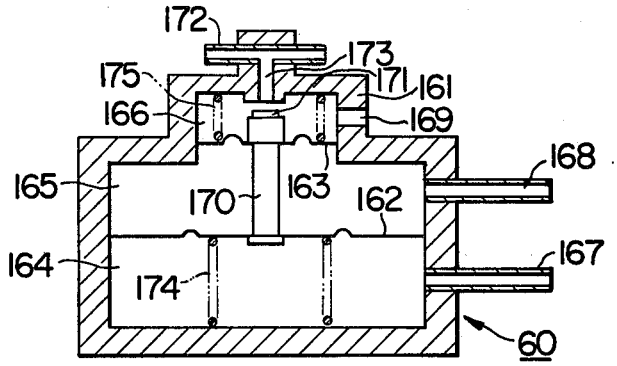
FIG. 8 is a sectional view of a comparator used in the fifth embodiment.

Fifth Embodiment, FIGS. 7 and 8

In the fifth embodiment to be described in detail with reference to FIGS. 7 and 8, the present invention is shown as being applied to a secondary air supply system of the type utilizing the pulsation of the pressure of exhaust gases for charging the secondary air.

The secondary air supply system 10 comprises a secondary air supply pipe 12, a reed valve 112 and the secondary air injection nozzle 14. The reed valve 112 consists of a relatively thin plate spring made of a resilient metal and is deflected away from the closed position only when the pressure in the exhaust manifold 2 goes negative for admitting the secondary air into the exhaust manifold 2. One end of the secondary air supply pipe 12 is opened to the surrounding atmosphere or connected to an air cleaner (not shown) while the other end is connected through the reed valve 112 to the injection nozzle 14 which in turn opens into the branches of the rake-type exhaust manifold 2. The secondary air pipe 12, the reed valve 112 and the injection nozzle 14 constitute a passage for admitting the secondary air into the exhaust manifold 2 under the control of the reed valve 112.

As with the case of the first embodiment shown in FIG. 1, the exhaust gas recirculation system 20 comprises the exhaust gas recirculation pipe 21 and the control valve 22. One end of the recirculation pipe 21 is connected to the exhaust manifold or pipe 2 while the other end is communicated with the intake manifold or pipe 3 upstream of the throttle valve 4. The control valve 22 is inserted in the recirculation pipe 21. The exhaust gas recirculation system 20 controls the volume of exhaust gas to be recirculated into the intake manifold 3 as a function of the pressure (back pressure) of exhaust gases in the exhaust manifold 2.

The secondary air control valve 30 which is actuated by the actuating device 40 is disposed within the secondary air supply pipe 12 for controlling the cross sectional area thereof to control the flow rate of the secondary air. As with the case of the first embodiment the secondary air control valve 30 is of the butterfly type and is disposed upstream of the reed valve 112.

In this embodiment, the negative pressure at the throat of a restriction 150 inserted in the secondary air supply pipe 12 upstream of the control valve 30 is used as the signal representative of the volume of secondary air, and is admitted through a first pressure tapping pipe 151 into a comparator 160. In like manner as in the first embodiment, the negative pressure at the throat of the venturi 6 is used as the signal representative of the volume or flow rate of intake air and is admitted through a second pressure tapping pipe 53 into the comparator 160. The negative pressure downstream of the throttle valve 4 is used as a control signal and is admitted through a third pressure tapping pipe 54 into the comparator 160. In the comparator 160 the control signal or negative intake pressure is regulated and is transmitted to the actuating device 40 through the fourth pressure pipe 55. The actuating device 40 is similar in construction to the device described in detail in conjunction with the first embodiment.

Next referring to FIG. 8, the comparator 160 of the fifth embodiment will be described in detail. The comparator 160 has a housing 161 which is divided by first and second diaphragms 162 and 163 into first, second and third pressure chambers 164, 165 and 166. The first diaphragm 162 has a pressure receiving area larger than the second diaphragm 163. Admitted into the first pressure chamber defined by the housing 161 and the first diaphragm 162 is the negative pressure at the throat of the venturi through the second pressure tapping pipe 53 and a first pipe 167. Admitted into the second pressure chamber 165 defined between the first and second diaphragms 162 and 163 is the negative pressure at the restriction 150 through the first pressure tapping pipe 151 and a second pipe 168. Atmospheric pressure is admitted through a port 169 into the third pressure chamber 166 defined by the housing 161 and the second diaphragm 163. The first and second diaphragms 162 and 163 are connected with a shaft 170 having a valve body 171 attached to one end (the upper end in FIG. 8) of the shaft 170. The valve body 171 closes or opens a port 173 intercommunicating the third pressure chamber 166 and a third pipe 172. One end of the third pipe 172 is connected to the third pressure pipe 54 (See FIG. 7) for admitting the negative pressure downstream of the throttle valve 4 while the other end is communicated with the fourth pressure pipe 55 so that the negative pressure downstream of the throttle valve 4 may be transmitted to the first pressure chamber 44 of the actuating device 40. Range springs 174 and 175 are loaded in the first and third pressure chambers 164 and 166, respectively, to settle the original position of the shaft 170 and hence the valve body 171.

The first diaphragm 162 is caused to be displaced downwardly by the negative venturi pressure admitted into the first pressure chamber 164 and displaced upwardly by the negative pressure at the restriction 150 admitted into the second pressure chamber 165. The second diaphragm 163 is displaced downwardly under the negative pressure admitted into the second pressure chamber 165.

Let P, denote the absolute value of the negative pressure at the throat of the venturi 6, $P_2$ the absolute value of the negative pressure at the restriction 150, $A_1$ the pressure receiving area of the first diaphragm 162, $A_2$ the pressure receiving area of the second diaphragm 163, $W_1$ the force acting downwardly due to the negative pressure at the throat of the venturi, and $W_2$ the force acting upwardly due to the negative pressure at the restriction 150. Then, $$W_1 = P_1 \cdot A_1 \text{ and}$$

$$W_2 = P_2 \cdot A_1 - P_2 \cdot A_2 = P_2[A_1 - A_2]$$

Therefore the displacement of the shaft 170 and hence the valve body 171 is dependent upon the difference between the forces $W_1$ and $W_2$.

Under the condition in which the forces $W_1$ and $W_2$ are balanced as shown in FIG. 8, when the volume of intake air is increased so that the negative venturi throat pressure admitted into the first pressure chamber 164 is increased, the shaft 170 and hence the valve body 171 are displaced downwardly so that the atmospheric air flowing through the port 173 into the third pipe 172 is increased in volume and consequently the negative pressure transmitted through the third pipe 172 is decreased. On the other hand when the negative pressure at the throat of the venturi 6 is decreased the valve body 171 moves upwardly toward the port 173 so that the atmospheric air flowing into the third pipe 172 is reduced or completely interrupted and consequently the negative pressure in the third pipe 172 is increased. When the volume of secondary air is increased so that the negative pressure at the restriction 150 admitted into the second pressure chamber 165 is increased, the shaft 170 and hence the valve body 171 is moved upwardly so that the atmospheric air flowing through the port 173 into the third pipe 172 is reduced or completely interrupted and consequently the negative pressure in the third pipe 172 is increased. When the volume of secondary air is decreased so that the pressure at the restriction 150 admitted into the second pressure chamber 165 is decreased the valve body 171 is moved downwardly so that the atmospheric air flowing into the third pipe 172 is increased and consequently the negative pressure transmitted through the third pipe 172 is decreased.

Air whose flow rate or volume is controlled by the throttle valve 4 is mixed with fuel at the carburetor 5, and the air-fuel mixture is charged into the engine 1 and burned and discharged through the exhaust manifold or pipe 2 into the surrounding atmosphere.

As with the case of the first embodiment, the negative pressure at the throat of the venturi 6 is corelated with the volume of intake air introduced into the engine 1 in the following equation:

$$Q_1 = C_1 \cdot A_3 \cdot \sqrt{P_1}$$

where $Q_1$ = volume of intake air, $A_3$ = sectional area of venturi 6, $P_1$ = absolute value of negative pressure at the throat of the venturi 6, and $C_1$ = flow coefficient.

Meanwhile in the secondary air supply system 10, the reed valve 112 is opened when the pulsating pressure of exhaust gas (back pressure) is negative so that the secondary air is charged into the injection nozzle 14, from which the secondary air is injected into the branches of the raked-type exhaust manifold 2 so that unburned compounds such as CO, HC in the exhaust gases may be burned and reduced in quantity.

The negative pressure at the restriction 150 inserted in the secondary air supply pipe 12 is corelated with the volume of secondary air in the following equation:

$$Q_2 = C_2 \cdot A_4 \cdot \sqrt{P_2}$$

where $Q_2$ = volume of secondary air, $P_2$ = absolute value of negative pressure at restriction 150, $A_4$ = cross sectional area of restriction 150, and $C_2$ = flow coefficient.

As described previously, the secondary air control valve 30 is controlled by the actuating device 40 which in turn is controlled by the control signal or negative pressure downstream of the throttle valve 4 which in turn is controlled by the comparator 160 in response to the negative pressure at the throat of the venturi 6 and the negative pressure at the restriction 150. The control valve 30 therefore increases or decreases the cross sectional of the secondary air pipe 12 in such a way that the negative pressure at the throat of the restriction 150 may be proportional to the negative pressure at the throat of the venturi 6. That is, the following relation is established:

$$P_1 = K_1 \cdot P_2$$

where $K_1$ is a proportionality constant. Therefore it follows that $$Q_1 = K_2 \cdot Q_2$$

where $K_2$ is a proportionality constant. Thus the volume of secondary air is made proportional to the volume of intake air.

Next the mode of operation of the fifth embodiment with the above construction will be described in more detail. It is assumed that under the conditions shown in FIG. 7 the signal representative of the volume of intake air is proportional to the signal representative of the volume of secondary air. When the volume of intake air is increased so that the venturi throat pressure which is negative is increased, the comparator 160 so functions that the negative pressure admitted to the first pressure chamber 44 of the actuating device 40 is decreased. As a result the secondary air control valve 30 is opened in the direction in which the cross sectional area of the secondary air supply pipe 12 is increased so that the volume of secondary air flowing through the secondary air supply pipe 12, the reed valve 112 and the injection nozzle 14 into the exhaust manifold 2 is increased. But when the intake air is reduced in volume so that the negative pressure at the throat of the venturi 6 is decreased, the comparator 160 so functions that the negative pressure admitted into the first pressure chamber 44 of the actuating device 40 is increased and consequently the secondary air control valve 30 is rotated in the direction in which the cross sectional area of the secondary air supply pipe 12 is decreased. As a result of this, the secondary air flowing into the exhaust manifold 2 is decreased. When the secondary air is increased in volume so that the negative pressure at the restriction 150 is increased, the comparator 160 so functions that the negative pressure admitted into the first pressure chamber 44 of the actuating device 40 is increased and consequently the secondary air control valve 30 is rotated in the direction in which the cross sectional area of the secondary air supply pipe 12 is decreased. As a result of this the secondary air flowing into the exhaust manifold is reduced in volume. When the negative pressure at the restriction 150 is decreased due to the decrease in volume of secondary air flowing through the pipe 12, the negative pressure admitted into the first pressure chamber 44 of the actuating device 40 is decreased so that the secondary air control valve 30 is rotated in the direction in which the cross sectional area of the secondary air supply pipe 12 is increased. As a result of this, the secondary air to be introduced into the exhaust manifold 2 is increased in volume.

Thus the volume of secondary air supply may be made proportional to the intake air by controlling the secondary air control valve 30 in such a way that the signal representative of the secondary air supply may be proportional to the signal representative of the intake air. The secondary air may be supplied in exact quantity for removing the toxic compounds in the exhaust gases, and there arises no problem for cooling the exhaust gas purifying device. The substantial reduction of unburned compounds in the exhaust gases may be ensured.

The exhaust gas recirculation system 20 has a function of controlling the volume of exhaust gases to be recirculated into the intake manifold as a function of the back pressure, but the secondary air supply system described above will not adversely affect the operation of the exhaust gas recirculation system because the secondary air supply in proportion to the intake air may maintain the relation that the volume of exhaust gases to be recirculated is in proportion to the volume of intake air.

In the fifth embodiment, instead of the butterfly type secondary air control valve 30 a conventional poppet valve may be used, and the restriction 150 may be positioned downstream of the secondary air control valve 30. Furthermore instead of the restriction 150, a restriction may be inserted in the secondary air supply pipe 12 downstream of the control valve 30, and the pressures at the inlet and outlet of the restriction may be tapped and transmitted to the comparator as with the case of the first embodiment. Moreover, instead of the comparator 160, the comparators 60 and 90 of the types described with reference to FIGS. 2, 5 and 6 may be used.

Sixth Embodiment, FIGS. 9, 10, 11 and 12

Figure 9:
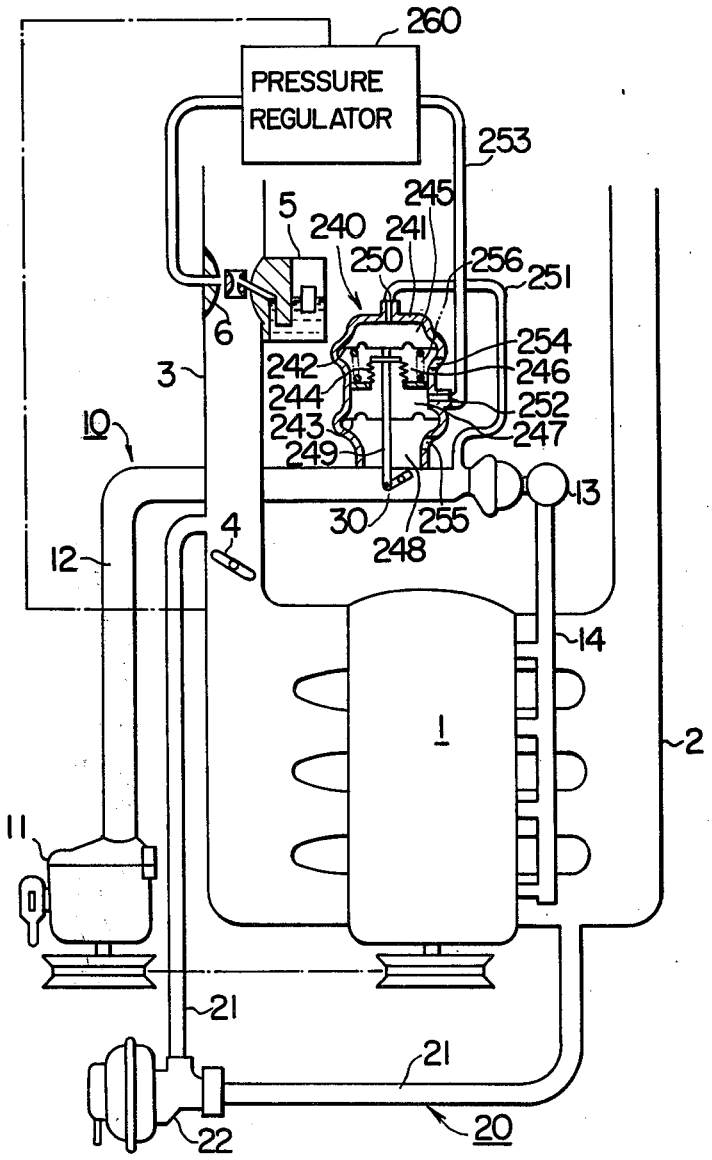
FIG. 9 is a schematic view of a sixth embodiment of the present invention.

The sixth embodiment to be described below with reference to FIG. 9 is similar to the first embodiment in that the air pump 11 is provided in order to supply the secondary air but is different in that instead of the comparator 60 is used a valve actuating device 240 which directly responds to both the signal representative of the intake air and the signal representative of the secondary air supply.

The valve actuating device 240 has a housing 241 which is divided by a first and second diaphragms 242 and 243 and a sealing bellows 244 disposed therebetween into first, second, third and fourth pressure chambers 245, 246, 247 and 248. The first and second diaphragms 242 and 243 and the sealing bellows 244 are connected with a shaft 249 having one (lower) end attached to the secondary air control valve 30. Therefore the first and second diaphragms 242 and 243 and the sealing bellows 244 are deflected in unison the shift the shaft 249, thereby opening or closing the control valve 30.

Admitted into the first pressure chamber 245 defined by the housing 241 and the first diaphragm 242 is the injection pressure of the secondary air downstream of the control valve 30 and upstream of the check valve 13 of the secondary air supply pipe 12, the tapped pressure being transmitted through a first pressure tapping pipe 251 and an intake port 250 of the housing 241. The negative pressure at the throat of the venturi 6 is admitted through a second pressure tapping pipe 253 and an intake port 252 into the third pressure chamber 247 defined between the second diaphragm 243 and the sealing bellows 244. The second diaphragm 243 has a larger area than the bellows 244 so that the force acting on the second diaphragm 243 is the negative pressure per unit multiplied by the difference in area between the second diaphragm 243 and the bellows 244. The second and fourth pressure chambers 246 and 248 are communicated through intake ports 254 and 255 with the surrounding atmosphere. A bias spring 256 is attached to the first diphragm 242 so that the latter and hence the shaft 249 may be normally biased upwardly. Therefore the position of the shaft 249 and hence the control valve 30 is dependent upon the balance between the positive injection pressure of secondary air acting upon the first diaphragm 242 downwardly, the negative pressure at the throat of the venturi 6 admitted into the third pressure chamber 247, acting on the second diaphragm 243 upwardly, and the force of the bias spring 256 acting on the first diaphragm 242 upwardly. When the shaft 249 is moved upwardly in FIG. 9, the control valve 30 is opened, but when the shaft 249 is moved downwardly the control valve 30 is closed.

A pressure regulator or amplifier-damper 260 is inserted into the second pressure tapping pipe 253 in order to amplify or attenuate the negative pressure at the throat of the venturi to be admitted into the third pressure chamber 247 when the difference between the throat pressure (negative) and the injection pressure (positive) of the secondary air is so large that the proper operation of the valve actuating device 240 cannot be ensured only by the diaphragms having different areas. Therefore the pressure regulator 260 may be inserted into the first pressure tapping pipe 251 instead of the second or negative pressure tapping pipe 253.

Figure 10:
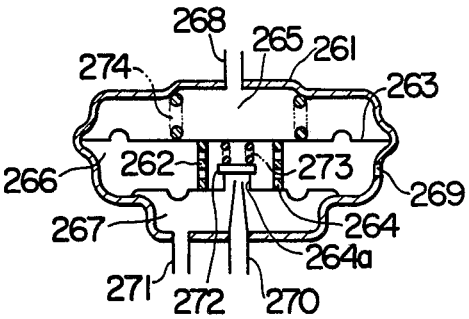
FIGS. 10 and 11 are sectional views of pressure regulators either of which may be used in the sixth embodiment.

In FIG. 10 there is shown one example of the pressure regulator 260 which is a negative pressure amplifier. The pressure regulator 260 has a housing 261 which is divided by first and second diaphragms 263 and 264 interconnected with a perforated pipe 262 into first, second and third pressure chambers 265, 266 and 267. The negative pressure at the throat of the venturi is admitted into the first pressure chamber 265 defined by the housing 261 and the first diaphragm 263 through the second pressure tapping pipe 253 (See FIG. 9) communicated with a first pipe 268. The second pressure chamber 266 defined between the first and second diaphragms 263 and 264 in the housing 261 is communicated through a vent 269 with the surrounding atmosphere. Admitted into the third pressure chamber 267 defined by the housing 261 and the second diaphragm 264 through a second pipe 270 is the negative pressure of intake air tapped downstream of the throttle valve 4 in the intake manifold or pipe 3. The third pressure chamber 267 is further communicated through an outlet pipe 271 with the third pressure chamber 247 of the valve actuating device 240 (See FIG. 9). The second diaphragm 264 is formed at the center thereof with a short, upwardly-directed cylinder 264*a* whose top opening is sealed with a valve element 272 which is attached to and biased with a spring 273 loaded in the second pressure chamber between the first diaphragm 263 and the valve element 272. The second negative pressure pipe 270 is extended into the short cylinder 264*a* with the open end (upper end) of the pipe 270 normally in contact with the valve element 272. A bias spring 274 is loaded in the first pressure chamber 265 for biasing the first diaphragm 263. The first diaphragm 263 has a larger area than the second diaphragm 264.

When the venturi throat pressure which is negative and is admitted into the first pressure chamber 265 is increased, the first diaphragm 263 is deflected upwardly, and so is the second diaphragm 264. Therefore the valve element 272 is moved upwardly against the spring 274 away from the open end of the second negative pressure pipe 270 so that the negative pressure tapped downstream of the throttle valve 4 is admitted into the third pressure chamber 267, increasing the negative pressure therein. When the negative intake air pressure is increased excessively or when the venturi-throat negative pressure is decreased, the second diaphragm 264 is deflected downwardly so that the valve element 272 moves toward and closes the open end of the second pressure pipe 270, whereby the negative intake air pressure is prevented from being admitted into the third pressure chamber 267. When the second diaphragm 264 is further deflected downwardly, the valve element 272 is moved away from the top opening of the short cylinder 264*a* so that the atmospheric air is admitted from the second pressure chamber 266 into the third pressure chamber 267, decreasing the negative pressure in the latter. As a result of this, transmitted through the outlet pipe 271 to the third pressure chamber 247 of the valve actuating device 240 is the negative pressure which is, as compared with the venturi throat negative pressure, multiplied or amplified by a factor corresponding to the difference in pressure acting area between the first and second diaphragms 263 and 264.

Figure 11:
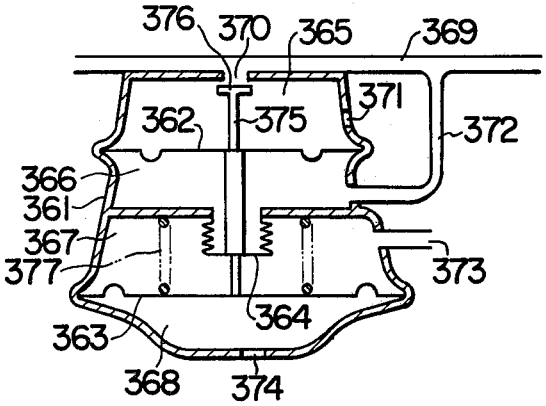

In FIG. 11 there is shown another example of the negative pressure regulator 260 which is in attenuator. The attenuator 260 has a housing 361 which is divided into four pressure chambers 365, 366, 367 and 368 by first and second diaphragms 362 and 363 and a sealing bellows 364. The first pressure chamber 365 is communicated through a port 370 with a negative intake air pressure pipe 369 and through a port 371 with the surrounding atmosphere. The second pressure chamber 366 is communicated through a negative pressure bypass pipe 372 with the negative intake air pressure pipe 369. The third pressure chamber 367 is communicated through a negative pressure pipe 373 with the venturi of the carburetor so that the negative pressure at the throat of the venturi is admitted in this chamber. The fourth pressure chamber 368 is communicated through a port 374 with the surrounding atmosphere. The first diaphragm 362 has a pressure acting area smaller than the second diaphragm, and the bellows 364 has a pressure acting area smaller than the first diaphragm 362. These diaphragms and bellows are connected with a shaft 375 having the upper end terminated into a valve body 376 for opening or closing the port 370. The second diaphragm 363 is loaded with a spring 377 for counteracting the venturi throat pressure. The negative intake air pressure pipe 369 is communicated with the third pressure chamber 247 of the valve actuating device 240 (See FIG. 9).

When the negative pressure in the second pressure chamber 366 is greater than the negative pressure in the third pressure chamber 367, the shaft 375 is shifted downward to move the valve body 376 away from the port 370 so that the atmospheric air is admitted into the negative intake air pressure pipe 369, whereby the negative pressure is decreased. When the negative pressure transmitted through the pipe 369 is decreased excessively, the pressure difference between the second and third pressure chambers 366 and 367 causes the shaft 375 to move upwardly so that the valve body 376 is moved very closely toward the port 370 and consequently the atmospheric air flowing into the negative intake air pressure pipe 369 is decreased in volume. Thus, the negative pressure transmitted through the pipe 369 is attenuated by a factor corresponding to the difference in pressure acting area between the first and second diaphragms 362 and 363.

The amplifier or attenuator to be inserted into the pressure tapping pipe 251 (See FIG. 9) may be similar in construction to the amplifier shown in FIG. 10 or attenuator shown in FIG. 11 which may be so modified as to amplify or attenuate the positive pressure.

In the engine 1, the air whose volume or flow rate is controlled by the throttle valve 4 is admitted and mixed with fuel in the carburetor 5, and the air-fuel mixture is charged into the cylinders and burned and discharged through the exhaust manifold or pipe 2 into the surrounding atmosphere. The negative pressure at the throat of the venturi 6 of the carburetor is corelated with the volume of intake air admitted as shown in FIG. 3 and in the following equation:

$$Q = C_1 \cdot A_1 \sqrt{\Delta P}$$

where $Q$ = volume of intake air, $A_1$ = cross sectional area of venturi 6, $\Delta P$ = absolute value of negative pressure at the throat of venturi and $C_1$ = flow coefficient.

The back pressure in the exhaust manifold 2 is corelated with the volume of exhaust gases in the following equation:

$$Q_{EX} = C_2 \cdot A_2 \cdot \sqrt{\Delta P_{EX}}$$

where $Q_{EX}$ = volume of exhaust gas, $A_2$ = cross sectional area of exhaust pipe 2, $\Delta P_{EX}$ = back pressure, and $C_2$ = flow coefficient.

Figure 12:
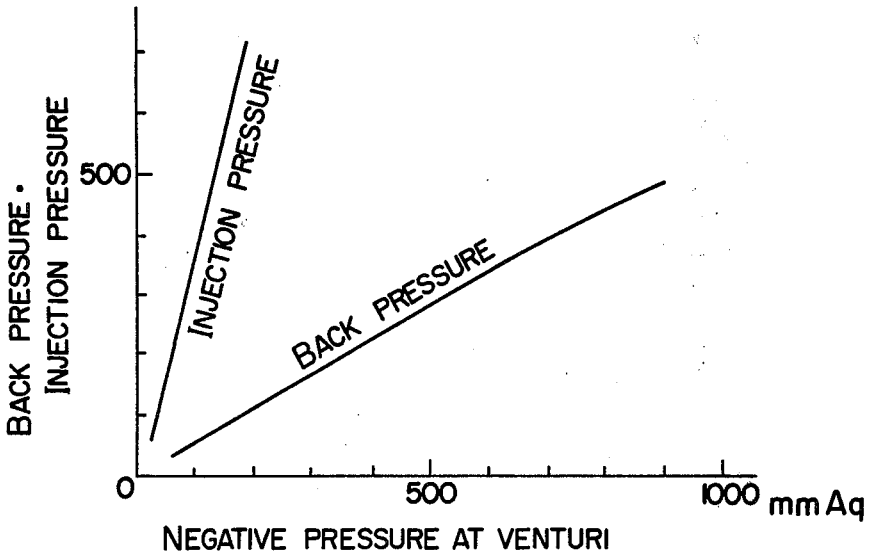
FIG. 12 is a graph used for the explanation of the mode of operation of the sixth embodiment shown in FIG. 9.

Since the volume of intake air equals the volume of exhaust gases, the back pressure is in proportion to the absolute value of the negative pressure at the throat of venturi as shown in FIG. 12.

Meanwhile, in the secondary air supply system 10, the air pump 11, which is driven by the engine 1, compresses the air and forces it to flow through the secondary air supply pipe 12 and the check valve 13 into the injection nozzle 14, where the compressed secondary air is injected into respective branches of the raked type exhaust manifold 2, whereby the unburned compounds such as CO, HC in the exhaust gases may be burned. As a result of this, the content of the unburned compounds in the discharged exhaust gas may be considerably reduced. The secondary air supply is corelated with both the back pressure and the injection pressure of the secondary air at which the secondary air is injected into the exhaust manifold 2, and is expressed by:

$$Q_{AI} = C_3 \cdot A_3 \cdot \sqrt{\Delta P_{AI} - \Delta P_{EX}}$$

where $Q_{AI}$ = secondary air supply $A_3$ = opening area of injection nozzle 14, $\Delta P_{AI}$ = secondary air injection pressure, and $C_3$ = flow coefficient.

The secondary air control valve 30 which is controlled by the valve actuating device 240 controls the cross sectional area of the secondary air supply pipe 12 in such a way that the secondary air injection pressure may be proportional to the absolute value of the negative pressure at the throat of the venturi as shown in FIG. 12. That is, the following relation is held:

$$\Delta P_{AI} = K_1 \cdot \Delta P$$

where $K_1$ is a proportionality constant. Therefore, $$\Delta P_{AI} = K_2 \cdot \Delta P_{EX}$$

where $K_2$ is a proportionality constant. Then, $$\begin{aligned} Q_{AI} &= C_3 A_3 \sqrt{\Delta P_{AI} - \Delta P_{EX}} \\ &= C_3 A_3 \sqrt{(K_2 - 1)\Delta P_{EX}} \\ &= C_3 A_3 \sqrt{K_1/K_2 (K_2 - 1)\Delta P} \\ &= K_3 Q \end{aligned}$$

Thus, the volume of secondary air supply is proportional to that of the intake air.

Next the mode of operation of the sixth embodiment for accomplishing the above relation will be described in detail. As described previously, admitted into the first pressure chamber 245 of the valve actuating device 240 through the first pressure tapping pipe 251 and the port 250 is the pressure of secondary air (that is, the secondary air injection pressure) tapped in the secondary air supply pipe 12 downstream of the control valve 30 but upstream of the check valve 13 so that the first diaphragm 242 is deflected downwardly. The negative pressure at the throat of the venturi 6 is admitted into the third pressure chamber 247 through the second pressure tapping pipe 253 and the port 252 so that the second diaphragm 243 is deflected upwardly. When the secondary air injection pressure varies relative to the sum of the venturi-throat pressure and the force of the spring 246, the shaft 249 is shifted to open or close the control valve 30, whereby the secondary air injection pressure is varied until it is balanced with the above combined force. More particularly, when the secondary air injection pressure increases in excess of the balanced or equilibrium level or when the negative pressure at the throat of the venturi drops below a predetermined level, the shaft 249 is shifted downwardly in FIG. 9 so that the control valve 30 is rotated in the direction in which the cross sectional area of the secondary air supply pipe 12 is descreased, whereby the injection pressure may be decreased. On the other hand, when the injection pressure is decreased or when the venturi-throat pressure is increased, the shaft 249 is shifted upwardly in FIG. 9 so that the control valve 30 is opened and consequently the secondary air injection pressure is increased. Therefore the secondary air injection pressure is made proportional to the negative pressure at the throat of the venturi 6 and consequently the secondary air supply is made proportional to the volume of intake air. If required, after the injection pressure has been made proportional to the negative pressure at the throat of the venturi, the temperature compensation may be made so that the mass or weight of the secondary air to be supplied may be made proportional to the mass or weight of intake air admitted.

Since the secondary air supply is made proportional to the volume of intake air, the secondary air may be always injected into the exhaust gases in exact quantities required for burning the unburned compounds in the exhaust gases. Therefore the substantial reduction of the unburned compounds in the exhaust gases may be ensured, and there does not arise the problem of overcooling the exhaust gas purifying device.

The secondary air supply system described above will not adversely affect the operation of the exhaust gas recirculation system 20 which controls the volume of exhaust gases to be recirculated as a function of the back pressure because when secondary air is supplied in proportion to the volume of intake air, the conditions for making the volume of exhaust gases to be recirculated proportional to the volume of intake air can be maintained.

It is to be understood that instead of the butterfly type secondary air control valve 30, a conventional poppet valve may be used in a manner substantially similar to that described with reference to the arrangement shown in FIG. 4.

What is claimed is:

1. A device for supplying secondary air for purifying exhaust gases discharged from an internal combustion engine comprising (a) a secondary air supply pipe in communication with an exhaust manifold or pipe of said engine, (b) means for supplying secondary air through said secondary air supply pipe into said exhaust manifold or pipe, (c) secondary air control valve means disposed in said secondary air supply pipe for controlling the flow rate of the secondary air flowing therethrough, (d) means for detecting the volume of intake air to said engine, (e) means for detecting the volume of the secondary air flowing through said secondary air supply pipe, and (f) means responsive to the signal representative of the detected volume of intake air and the signal representative of the detected volume of secondary air for controlling said secondary air control valve means in such a way that the volume of the secondary air supply may be in proportion to the volume of intake air;

said means for controlling said secondary air control valve means comprising:

(a) a comparator responsive to said signal representative of the detected volume of intake air and said signal representative of the detected volume of secondary air for generating a control signal, and (b) actuating means responsive to said control signal for controlling said secondary air control valve means;

said means for detecting the volume of intake air being adapted to detect the negative pressure at the venturi of a carburetor of said engine, said means for detecting the volume of secondary air is adapted to detect the pressure difference across a restriction means inserted in said secondary air supply pipe, said comparator further includes a negative pressure pipe intercommunicating said actuating means and an intake manifold or pipe of said engine, a vent for communicating said negative pressure pipe with the surrounding atmosphere, and negative pressure control valve means adapted to be displaced in one direction in proportion to the negative pressure at the venturi and in the other direction in proportion to said pressure difference across said restriction means for controlling the opening degree of said vent, and said actuating device is actuated in response to the negative pressure of intake air which is transmitted through said negative pressure pipe and regulated by said negative pressure control valve means;

said comparator comprising:

(a) a housing, (b) first, second and third diaphragms disposed within said housing for dividing it into four pressure chambers, (c) said negative pressure at said venturi being admitted into a first pressure chamber defined by said housing and said first diaphragm, (d) the pressure at the outlet of said restriction means inserted in said secondary air supply pipe being admitted into a second pressure chamber defined between said first and second diaphragms, (e) the pressure at the inlet of said restriction means being admitted into a third pressure chamber defined between said second and third diaphragms, (f) the atmospheric pressure being admitted into a fourth pressure chamber defined by said housing and said third diaphragm, said fourth pressure chamber being communicated with said negative pressure pipe through a communication port, (g) the pressure acting area of said second diaphragm being smaller than those of said first and third diaphragms, (h) a shaft for interconnecting said first, second and third diaphragms, one end of said shaft being connected to said first diaphragm while the other end being extended into said fourth pressure chamber, and (i) a valve body attached to said other end of said shaft in opposed relation with said communication port for controlling the degree of opening of said communication port.

2. A device as set forth in claim 1, wherein:

the pressure acting area of said third diaphragm is larger than that of said first diaphragm.

3. A device as set forth in claim 1, wherein:

said comparator further comprises:

a fourth diaphragm disposed between said first and second diaphragms for forming a fifth pressure chamber between said first and fourth diaphragms to be communicated with the atmosphere.

4. A device as set forth in claim 3, wherein:

the pressure acting area of said fourth diaphragm is the same as that of said third diaphragm.

5. A device as set forth in claim 3, wherein:

the pressure acting area of said first diaphragm is larger than that of said third diaphragm.

6. A device as set forth in claim 3, wherein:

said comparator further comprises:

a restriction disposed in a pipe for admitting the negative pressure at said venturi to said first pressure chamber.

* * * * *